United States Patent [19]

Smith, III et al.

[11] Patent Number: 5,067,079

[45] Date of Patent: Nov. 19, 1991

[54] INTERACTIVE AUDIO BASEBALL GAME

[75] Inventors: Jay Smith, III, Los Angeles; Jeffrey W. Fort, Santa Barbara, both of Calif.

[73] Assignee: Smith Engineering, Culver City, Calif.

[21] Appl. No.: 307,301

[22] Filed: Feb. 6, 1989

[51] Int. Cl.[5] ..... G06F 15/44; A63F 9/00; A63F 7/06

[52] U.S. Cl. ..... 364/410; 273/85 G; 273/88

[58] Field of Search ..... 364/410; 273/1 E, 88, 273/85 G

[56] References Cited

U.S. PATENT DOCUMENTS

| | | | |
|---|---|---|---|
| 4,324,402 | 4/1982 | Klose | 273/88 |
| 4,326,710 | 4/1982 | Breslow et al. | 273/1 E |
| 4,372,557 | 2/1983 | Del Principe et al. | 273/88 |
| 4,381,864 | 5/1983 | Bromley et al. | 273/88 |
| 4,395,760 | 7/1983 | Soski et al. | 364/410 |
| 4,672,541 | 6/1987 | Bromley et al. | 364/410 |
| 4,834,375 | 5/1989 | Elstein et al. | 273/26 R |

FOREIGN PATENT DOCUMENTS

| | | | |
|---|---|---|---|
| 2016774 | 9/1979 | United Kingdom | 273/88 |

OTHER PUBLICATIONS

"APBA Major League Players Baseball-'89 Master Edition" Software Program Description, American School Publishers, New York, NY Jan. 1989, (Available in 1985), Publisher: Random House, Inc. New York, NY.

"Full Count Baseball" Software Program Description, Lance Haffner Games, Nashville, TN, Mar. 1987.

"Computer Statis Pro Baseball" Software Program Description, Avalon Hill Game Co., Baltimore, MD, Release Date Unknown.

"Pro Manager" Software Program Description, Avalon Hill Game Co., Baltimore, MD, Jan. 1984.

"Audio Comes to Video Games (Milton Bradley's Championship Baseball)" *Changing Times*, vol. 37, Aug. 1983, 9. (Abstract Only).

"Championship Baseball Arcade Plus Series" Software Program Description, Texas Instruments, Release Date Unknown.

"Play Sportronix Baseball" Software Program Description, Sportronix, Springfield, OH, Apr. 1985.

"Pure-Stat Baseball" Software Progam Description, Software Simulations, Stratford, CT., Apr. 1986.

*Primary Examiner*—Clark A. Jablon

*Attorney, Agent, or Firm*—Joseph C. Andras

[57] ABSTRACT

In a microprocessor based interactive audio game for two users to play against one another, or for one user to play against the computer, the game having the ability to store and retrieve sets of statistical data corresponding to the performance of actual players, keys for the users to affect the state of the game, and an audio output for communicating the state of the game or the results of a game play to the users, the audio output for a particular game state or game play result being variable in order to maintain user interest. A plurality of visual indicators are arranged in a grid that represents the flight of a thrown ball through a vertical cross section of the strike zone. Visual indicators are sequentially flashed a predetermined number of times and in a predetermined pattern for a particular variety of pitch.

15 Claims, 12 Drawing Sheets

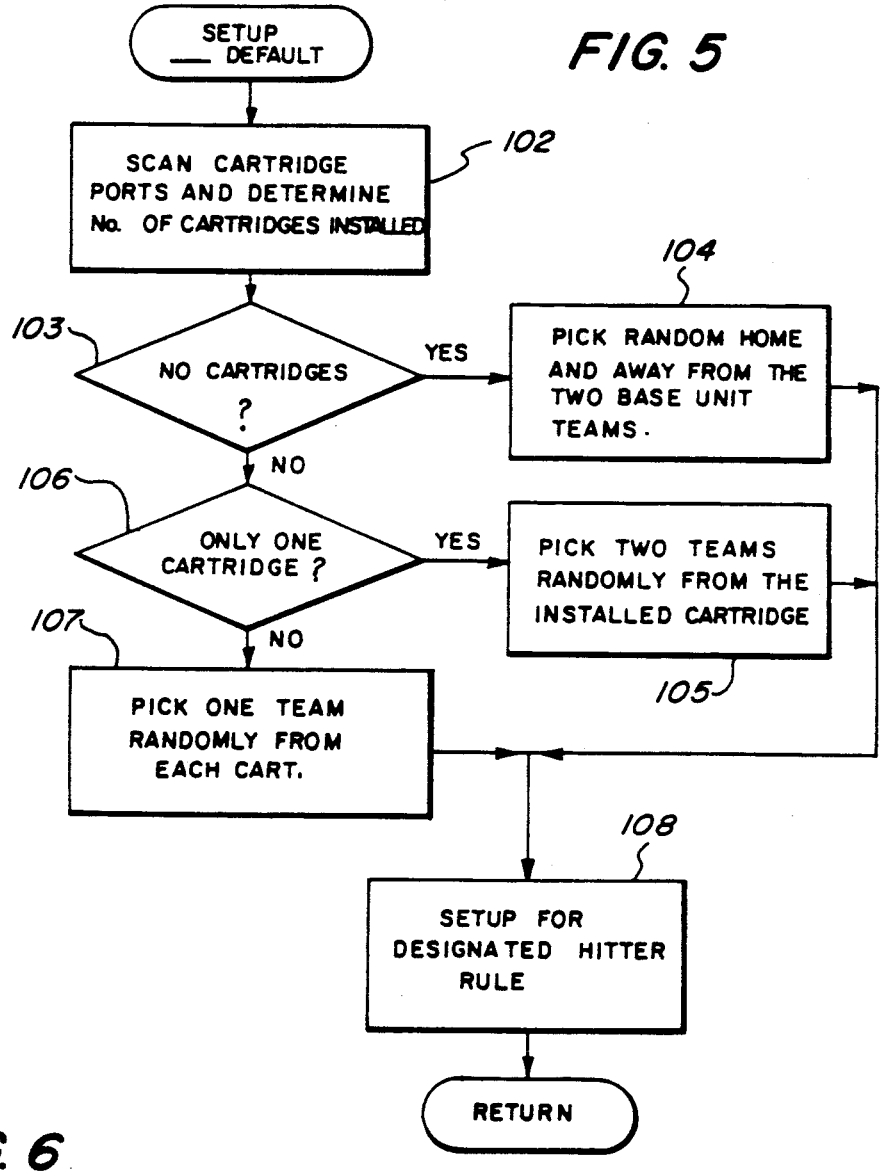
FIG. 5
FIG. 6
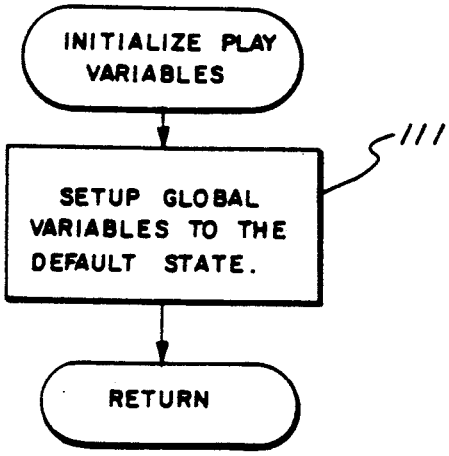

INTERACTIVE AUDIO BASEBALL GAME

BACKGROUND OF THE INVENTION

1. Field of the Invention

The present invention generally relates to an electronic game wherein the user is provided with an audio indication of the result of a game play and of the status the game in general.

2. Description of the Prior Art

Ever since the advent of sporting events, people have endeavored to create games that simulate the excitement and complexity of an actual real-life competition. Baseball and football are two exemplary sports that have spawned large families of such simulation games.

There are numerous mediums in which such games have been cast. For example, there are many card based games or board games that incorporate either cards or dice. Nearly everyone is familiar with the electric football game where the players first set up the opposing teams and then vibrated the men through a play. As exemplified by the vibrating football game, many of the older games lack the reality and complexity of the actual sport.

In recent years, a number of electronic or microprocessor based sports simulation games have been developed. While the more recent electronic games have allowed for additional complexity and reality to be incorporated into the game, there still exists a problem associated with the manner in which game results are communicated to the user. Such electronic games typically employ various combinations of visual and audio outputs to communicate with the user. However, modern electronic games invariably have a fixed output (whether audio or visual or both) for each of the possible game results. The users quickly lose interest in the game because the game must continually repeat the fixed set of outputs.

Thus there is still a need to improve complexity and reality in both the manner of play in sports simulation games and in the manner in which results are reported to the users of the game.

SUMMARY OF THE INVENTION

The present invention provides an apparatus for a microprocessor based interactive audio game that may be used by two players competing against one another or by one user competing against the computer. The interactive audio game of the present invention is suitable for simulating a baseball game, a football game, or any other competitive sports simulation game that has a multiplicity of possible game states.

The present invention further includes input means that allows one or more players to vary the state of the game. The input means may comprise, for example, a panel of buttons that correspond to specific actions a user may take during a particular game state. For instance, in a baseball game where the game state is such that the ball has been pitched and is on the way to home plate, a user operating a panel of buttons could select a type of hit and when to swing.

An audio means is employed for providing to the users an audio output that corresponds to the current game state. By way of example, the audio output could comprise a software based speech synthesis program whereby RAM or ROM based strings or phrases to be spoken are processed by the microprocessor and then provided to a D/A converter, amplified, and ultimately delivery to an ordinary audio speaker. For example, in a baseball game according to the present invention, the audio output might comprise the synthesized voice of a sportscaster as well as synthesized sounds such as, but not limited to, crowd cheers or the sound of the bat hitting the ball.

In order to provide a desirable variety of outputs and in order to maintain the user's interest, the audio means of the present invention operates in cooperation with a means for variably selecting one of plurality of audio outputs which correspond to a particular game state.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

The just-summarized invention will now be described in detail in conjunction with the drawings of which:

FIG. 5 is a flow chart of the Setup Default subroutine of the routine of FIG. 4. FIG. 6 is a flow chart of a subroutine used to initialize various play variables.

DETAILED DESCRIPTION OF THE PREFERRED EMBODIMENT

The following description is provided to enable any person skilled in the field of electronic games to make and use the invention and sets forth the best modes contemplated by the inventor of carrying out his invention. Various modifications, however, will remain readily apparent to those skilled in these arts, since the generic principles of the present invention have been defined herein specifically to provide a relatively desireable apparatus for use as an interactive electronic game.

Figure 1:
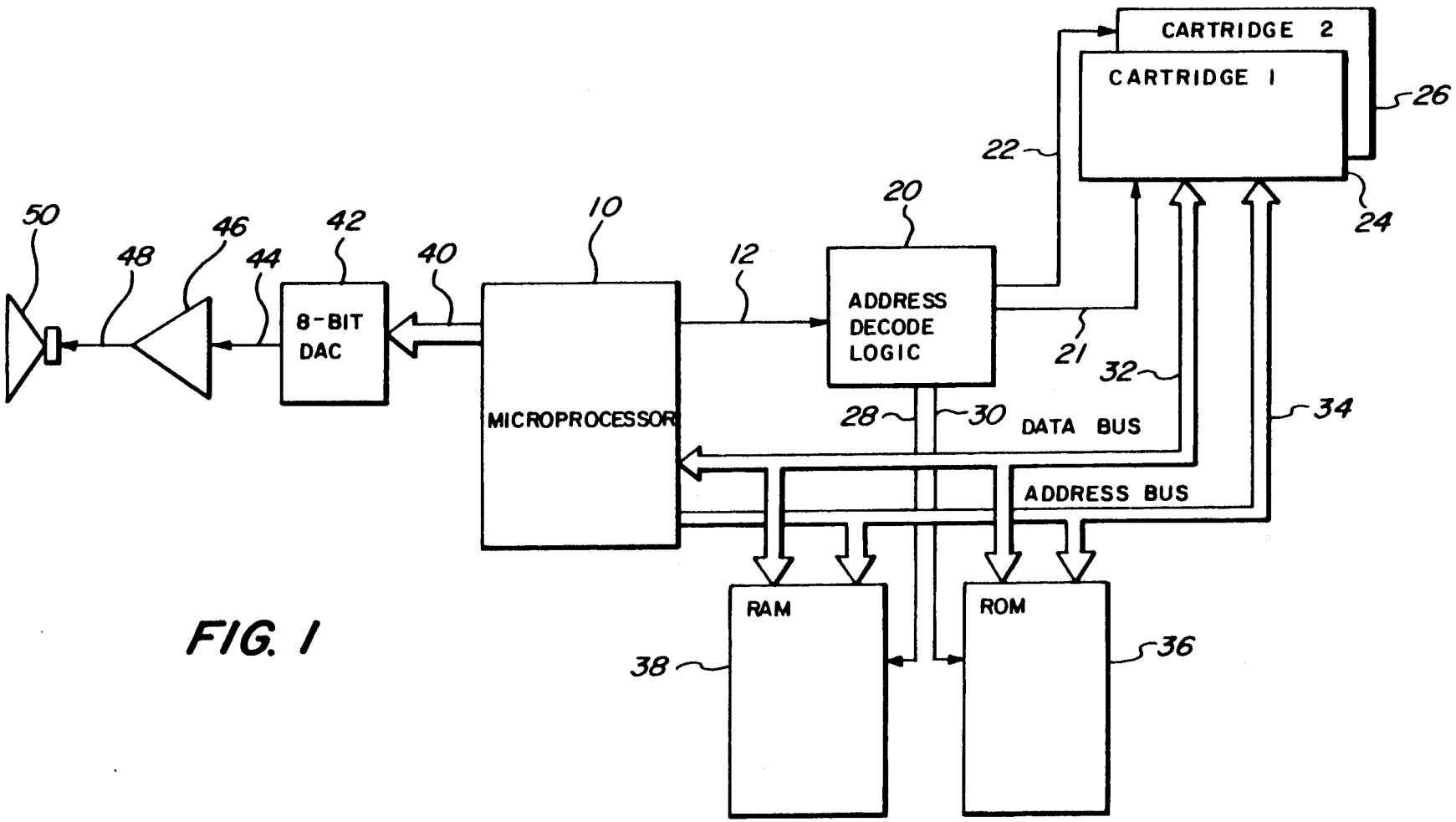
FIG. 1 is a block diagram showing an exemplary microprocessor circuit which may be used to practice the present invention.

With reference to FIG. 1, a generalized block diagram of one apparatus suitable for carrying out the present invention is shown. Because there are numerous prior art microprocessors and bus systems suitable for practicing the present invention, the block diagram of FIG. 1 and the following description are intended to be general.

FIG. 1 depicts a microprocessor 10 and various surrounding components. In particular, microprocessor 10 is connected to a ROM 38 and a RAM 36 in the usual fashion via an address bus 34 and a data bus 32. The microprocessor is also connected to external ROM cartridges 1 and 2 via the data bus 32 and address bus 34. A multiline control signal 12 is provided to an address decode logic circuit 20 which provides enable signals 21, 22, 28, and 30 to the external cartridge 1, the external cartridge 2, the RAM 38, and the ROM 36, respectively. The microprocessor 10 is further connected via an output line 40 to a D/A converter 42, the D/A converter 42 then providing an analog output signal 44 to an amplifier 46. The output of the amplifier 46 is provided to a speaker 50 via line 48. The software employed with the foregoing hardware may include algorithms for producing synthetic speech or sound effects which may be provided to the speaker 50 by microprocessor 10 via the D/A converter and the amplifier 46. A speech algorithm suitable for this application is disclosed in U.S. Pat. No. 4,214,125 issued to ESS of Emeryville, California.

In a preferred embodiment of the present invention, a program used in conjunction with the apparatus of FIG. 1 and discussed further herein, is comprised of program segments or scripts, which when desired, are used to select one of several audio outputs or phrases suitable for a then current game state.

Figure 2A:
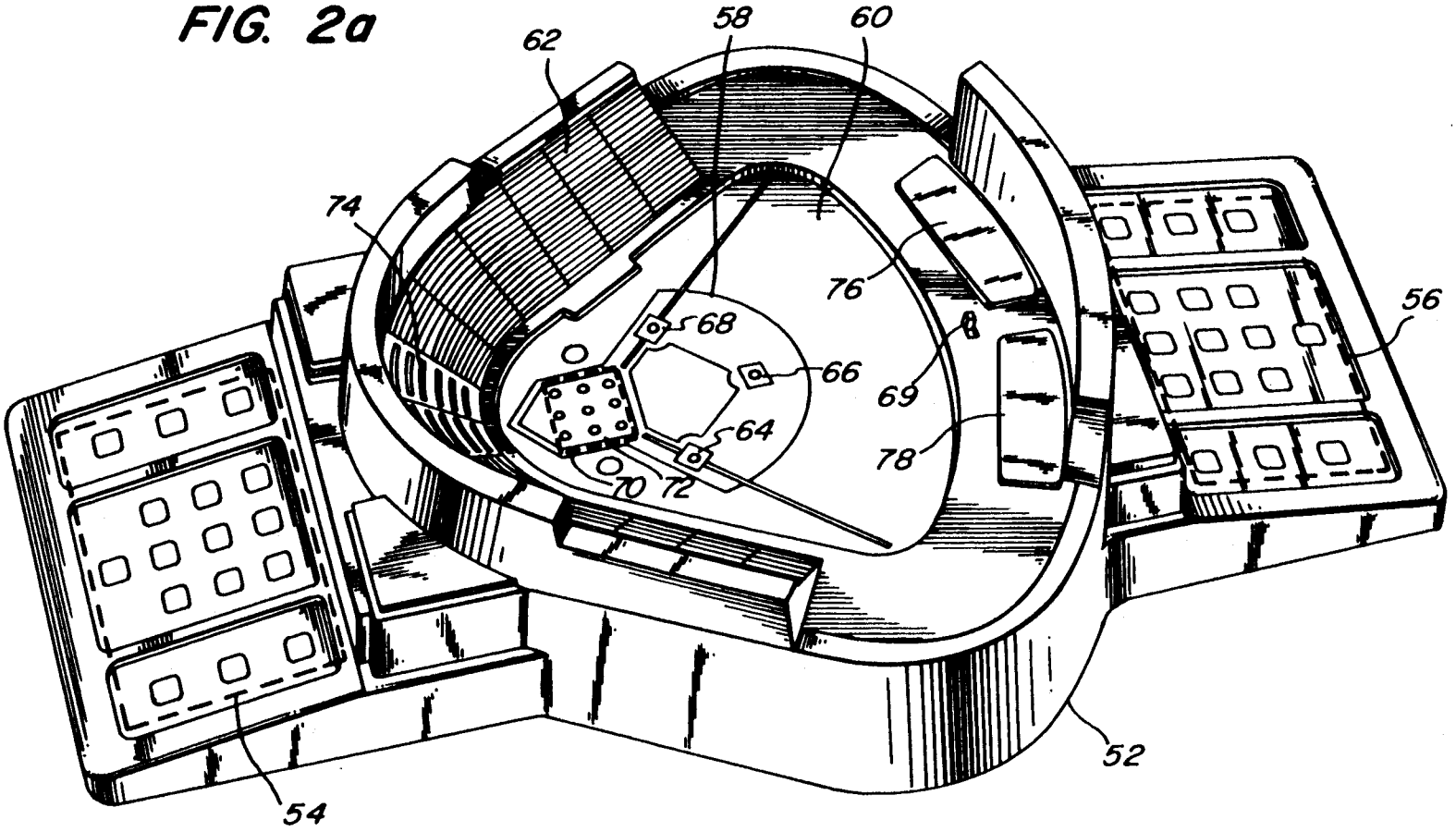
FIG. 2*a* is an isometric view of a preferred embodiment of the of the present invention.
Figure 2B:
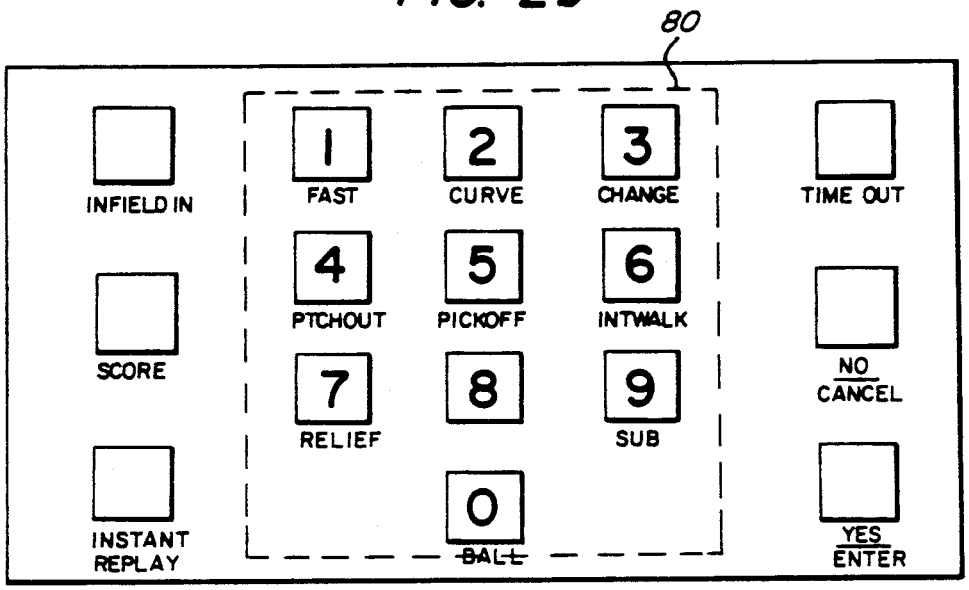
FIG. 2*b* is a schematic layout of the pitching control panel.

FIG. 2*a* depicts an isometric of a preferred embodiment of a game assembly according to the present invention. A housing 52 is made of plastic, the arrangement of the housing being such that users may face each other while playing the game. When the game is played by two users, a set of pitching control buttons 54 faces one user while a set of batting control buttons 56 faces the other user. The two users simply turn the housing 52 around when taking the field or when coming to bat. As further shown in FIG. 2*a*, the housing 52 includes a center portion which resembles an authentic baseball diamond 58, field 60, and bleachers 62. The baseball diamond 58 contains three base-runner LEDs 64, 66, and 68 which, when lit, represent runners on first base, second base, or third base, respectively. A three position Coach/Off/Player switch 69 is located behind center field 60 on the housing 52. An enlarged representation of home plate 70 is provided for encompassing a uniform array of LEDs 72, the LED's being selectively lit to represent the flight of a pitch thrown by the user operating the pitching control buttons 54. The speaker 50 (not shown in FIG. 2*a*) is provided behind a grill 74 molded into the bleacher portion 62 of the housing 52. The speaker 50 provides the users with various audio outputs representative of the current game status or the current action taking place.

Detailed views of the pitching control panel 54 and the batting control panel 56 are shown in FIGS. 2*a* and *b*, respectively. The pitching control panel 54 is comprised of numeric keypad 80 where several of the individual keys 0–9 of the numeric keypad have dual functions. The keys 1,2, and 3 are operated by the user to select the type of pitch (a fast ball, a curve ball, or a change-up, respectively). The keys 4, 5, and 6 are operated to select a pitchout, a pickoff attempt, or an intentional walk, respectively. Keys 7 and 8 correspond to bringing in a reliever or a substitute pitcher, and finally, key 0 may be operated to pitch an intentional ball. The pitching control panel is further comprised of an infield in key used to bring the infield in for an expected bunt or squeeze play, a score key for requesting a vocal report of the score, an instant replay for requesting a vocal replay of the most recent play, a time out key for temporarily delaying the game, and "YES" and "NO" keys for answering vocal prompts.

Figure 2C:
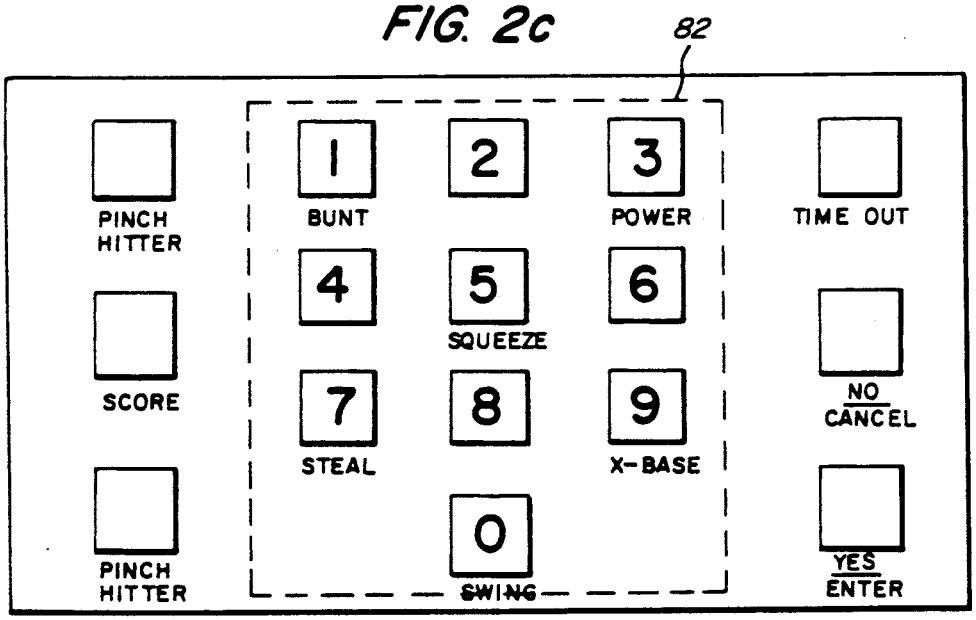
FIG. 2*c* is a schematic layout of the batting control panel

The batting control panel 56, depicted in FIG. 2*c*, is very similar to the pitching control panel 54. However, the dual functions of the numeric keys have been modified wherein the following keys have the designated dual function: 1—bunt, 3—power swing, 5—squeeze play, 7—steal attempt, 9—extra base, and 0—swing. The batting control panel further comprises a pinch hitter key, a pinch runner key. Also, like the pitching control panel 54, the batting control panel has a score button, a timeout button, and a "YES" and a "NO" button for responding to vocal prompts.

Figure 2D:
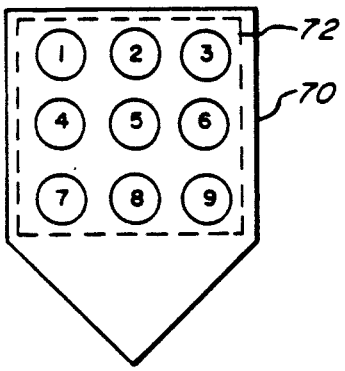
FIG. 2*d* is a detail of the LED array of FIG. 2*a* and showing the correspondence between the LEDs and the numeric keys of the pitching and batting control panels.

FIG. 2*d* is offered in order to demonstrate the positional correspondence that is intended between the numeric keys 1–9 of the two pitching and batting control panels 54, 56 and the LEDs numbered 1 to 9 that comprise the LED array 72. In a preferred embodiment, the flight of a pitched ball is represented by sequentially flashing appropriate LEDs 1 to 9. In one mode, a user pitches the ball by merely selecting the type of switch and then pressing the "enter" key twice. A ball pitched for a strike would be represented by six flashes where the first flash would correspond to the ball leaving the pitcher's hand and the remaining flashes corresponding to the flight of the ball as it nears the catcher's glove. At the fifth flash, the ball would be crossing the plate, and at the sixth flash, the ball would be in the catcher's glove, In order to successfully hit the ball, the user operating the batting control panel 56 must time a depression of the swing button to occur somewhere between the fifth and sixth flashes. Alternatively, the user operating the batting control panel 56 may "swing" at the pitched ball by observing the path of the ball based on the position of sequentially lit LEDs and by then depressing one of the numeric buttons 1-9 corresponding to the position the user expects the ball to be in as it crosses the strike zone. A pitch that is out of the strike zone for a ball would be represented by only four flashes of LEDs 72.

The position of the flashing LEDs represent the position of the ball as seen in the strike zone from the catcher's point of view. The user operating the pitching control panel 54 may select the flight of the ball by keying in the desired flight on the numeric keypad 80 and the user operating the batting control panel may select the position of his or her swing by depressing the desired number on the numeric keypad 82 rather than simply the swing button.

Figure 3:
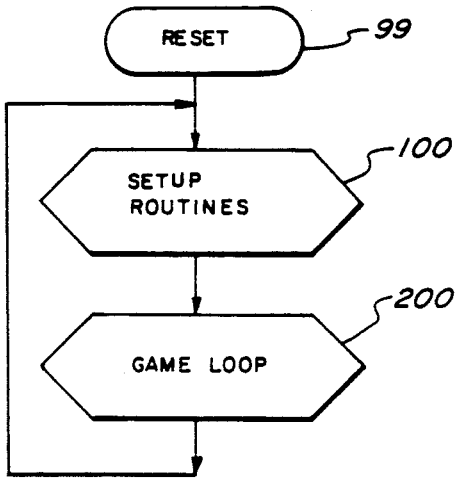
FIG. 3 is a flow chart of a main loop of a program employed with the apparatus of FIG. 1.

FIG. 3 depicts a flow chart showing the main loop of a computer program employed in the preferred embodiment. A general reset takes place at step 99 when the Coach/Off/Player switch 69 (FIG. 1) is switched from the "Off" position to either the "Coach" or the "Player" position. During the reset step 99, various internal tests are performed. Following the reset step 99, the flow proceeds to the setup routines step 100. Each of The individual setup routines which branch from step 100, depicted in FIG. 4, are used to initialize all the variables used by the program to a default state or to a particular state corresponding to particular user selections, describer further herein.

Step 101 sets up the two internal default teams unless an external ROM cartridge is installed and a user elects to substitute the internal default statistics with a team contained on an external ROM cartridge 24,26. Referring to FIG. 5, at step 102, the program scans the two cartridge ports 76, 78 in order to determine the number of external ROM cartridges that are installed. If no cartridges are installed, a branch occurs at step 103 to step 104 where the two internal default teams are randomly selected as the home team and the away team, respectively. If it is determined in step 103 that there is at least one cartridge, a decision is made at step 106 to determine whether only a single cartridge is installed. If the result of step 106 is "yes", the program flow proceed to step 105 wherein the two teams will be selected from that cartridge. If the result of step 106 is "no", indicating that two cartridges are installed, step 107 selects one randomly chosen team from each of the two cartridges. After the teams have been selected in step 104, step 105, or step 106, the statistical data pertaining to each player are copied to the RAM 38 from the internal ROM 36, or from one or both of the external ROM cartridges 24, 26, as appropriate. At step 108, the program setups the designated hitter rule if an American League team is the home team.

Step 110, entitled "initialize play variables", branches to step 111 (FIG. 5) wherein a group of global state variables is set to the proper values for entry into the game loop 200. A state variable is a variable that operates as a selector (not a scalar value), and causes a particular reaction in the program based upon its value. Exemplary state variables would include: runs, hits, errors, and initial pitcher fatigue rating.

Figure 4:
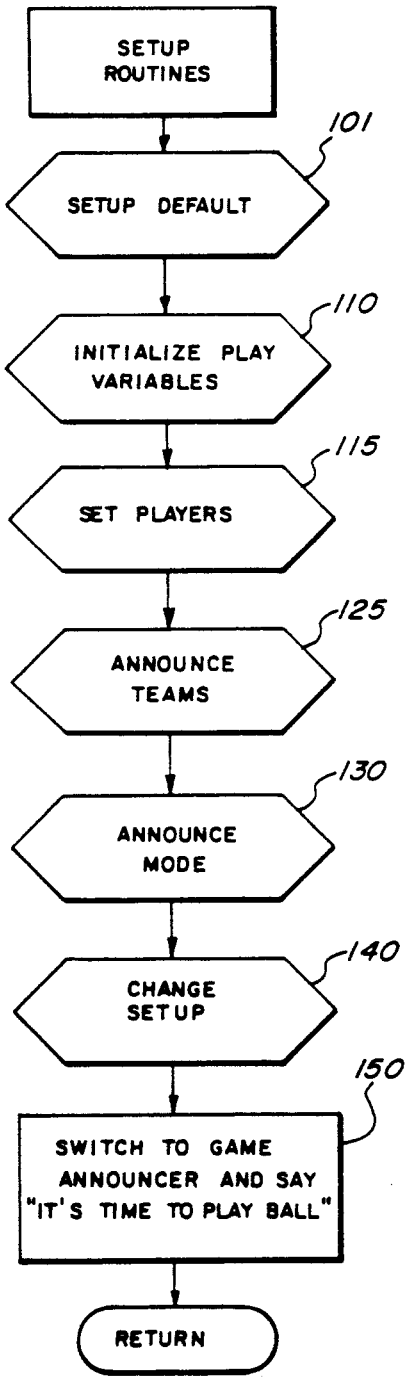
FIG. 4 is a flow chart of a routine used to setup various aspects of the game.
Figure 7:
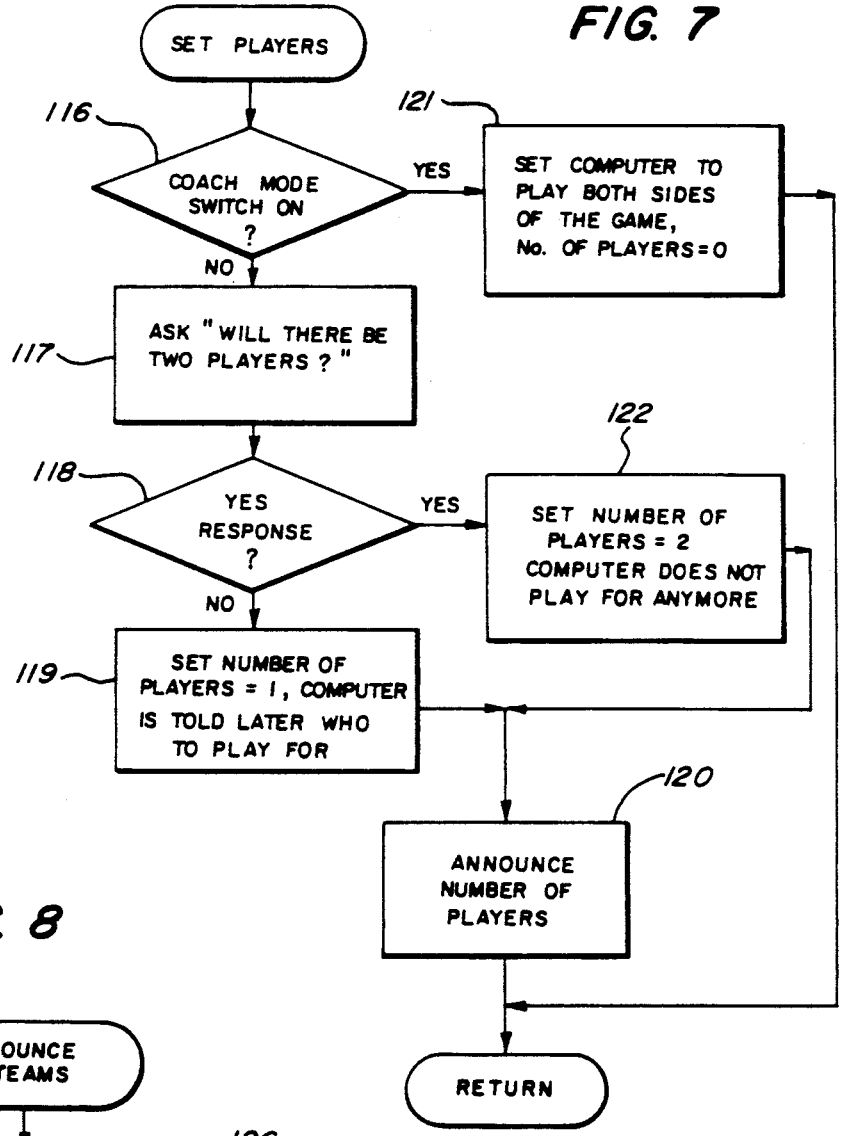
FIG. 7 is a flow chart of a subroutine used to set the number of user to zero, one or two.

At step 115 of FIG. 4, the set players routine sets up the program for zero, one, or two users based upon the position of the Coach/Off/Player switch 69 (FIG. 2). At step 116, as shown in FIG. 7, a determination is made as to whether the switch 69 is in the "Coach" position. If "no" (i.e. the game is in the "Player" mode) the game will determine the number of users at step 117 by asking "Will there be two players?" If a "NO" response is entered at step 118, the number of users is set to one in step 119. If a "YES" response is entered at step 118, the number of users is set to two in step 122. In either case, the game announces the number of users at step 120. If the switch 69 is determined to be in the Coach" position at step 116, step 121 sets the number of users to zero and the computer plays for both the pitching side and the batting side.

Figure 8:
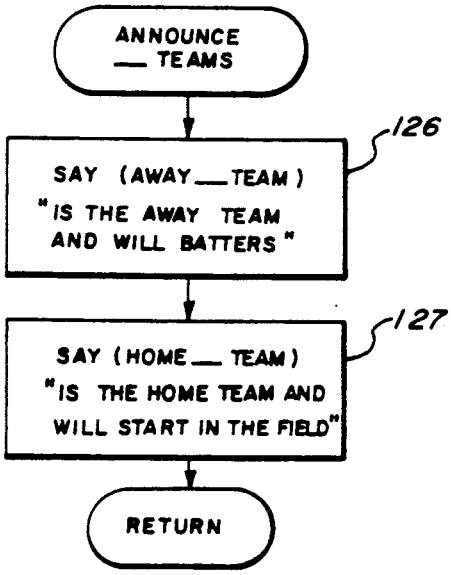
FIG. 8 is a flow chart of a subroutine used to announce the teams to the game users.

Returning to FIG. 4, the program proceeds to step 125 in order to announce the home and away teams as randomly selected in step 104, step 105, or step 107 of FIG. 5. At step 126 of FIG. 8, the game announces the away team by saying "[away-team]is the away team and will bat first." At step 127, the game announces the home team by saying "[home—team] is the home team and will start in the field." The program replace "home—team" and "away—team" with the actual team names (e.g. Chicago or Los Angeles).

Figure 9:
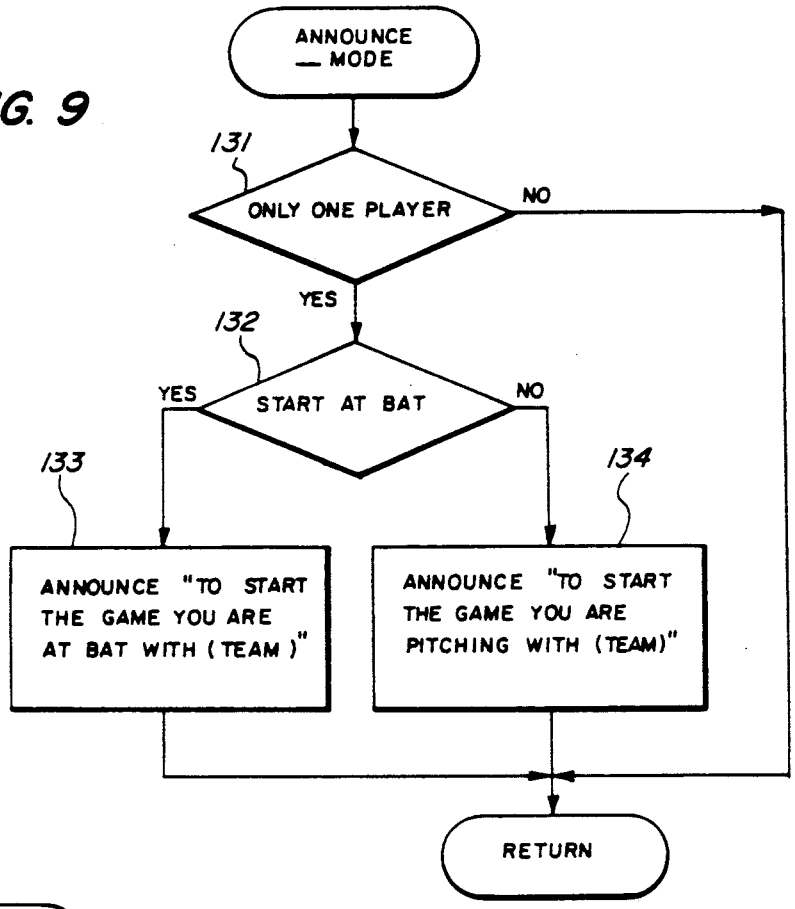
FIG. 9 is a flow chart of a subroutine used to inform the user whether the user's team will start at bat or in the field.
Figure 10:
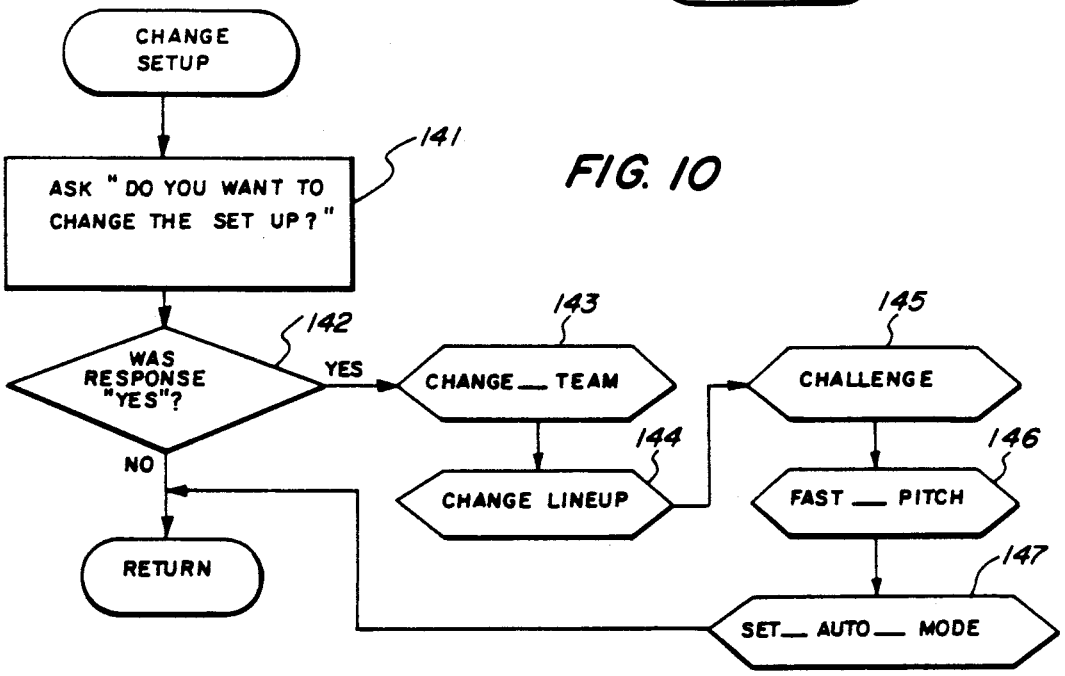
FIG. 10 is a flow chart of a subroutine offering the user various options for changing the setup of the game.

Step 130 in FIG. 4 branches to a routine which checks the number of users set in step 115 and, if there is only one user, determines whether that user will begin at bat or in the field. At step 131 in FIG. 9, the program determines if there is only a single user. If there is only one user, the program flow proceeds to step 132. At step 132, if the user is to start at bat (based upon the random selection of home versus away teams in step 101, et. seq.), the program will proceed to step 133 and announce "To start the game you are at bat with [away—team]". Alternatively, if the user is to start in the field, program flow will proceed from step 132 to step 134 where the game will announce to the user "To start the game you are pitching with [away—team]. As was done in step 126 and 127, the program will substitute the actual team name for "home—team" or "away—team."

At step 140 of FIG. 4, the user(s) is given the opportunity to change the current setup. At step 141, the game asks the user "Do you want to change this setup?" If the user's response is "YES" at step 142, program flow then continues to the change team routine of step 143. The change team routine of step 143 asks the user "Do you want to change a team?" If the user's response is "YES", the user will then be asked for two team identifying numbers which designate which designate the team to be input. If the team statistics corresponding to the team identifying numbers input by the user cannot be found, the game reports an error message and repeats the above prompt. If the team identifying numbers are correct, the statistical data pertaining to the players comprising each team are copied to the RAM 38 from the internal ROM 36, or from one or both of the external ROM cartridges 24, 26, as appropriate. If the users response to the step 143 prompt is "NO", program flow proceeds to the change lineup routine of step 144.

The change lineup routine of step 144 allows the user to change the lineup for either the home team or the away team. The user is prompted with "Do you want to look at the lineup for the (american or national) team?" The game queries the user with respect to first the American team and then the National team. If the user responds with a "YES" to either query, the game then queries the user with "Do you want to hear the starting lineup?" and, after reporting the batting order and field position for the entire lineup if the response is a "YES", or immediately if the response is "NO", asks the user "Do you want to put in an all new lineup?" If the user responds with a "YES", the game responds with a series of paired requests: "Put in the player number of the man to bat (first, second, etc...)" and "Put in the field position for (first player name, second player name, etc...). After the user enters a player number or a position, the entry is vocally echoed to the user and the user is given an opportunity to verify or correct the entry. After the user inputs the new lineup, or after having responded with a "NO" to the new lineup prompt, program flow continues to step 145.

In step 145, the user may enter a challenge mode wherein the user may set up any inning or score that is desired. The user is first queried with "Do you want to start the first inning?" If the user responds "YES", program flow proceeds to step 146. If the user responds "NO", the user is orally requested to first "Put in the number of the starting inning" then to "Put in the player number of the man at bat for the American team", to "Put in the player number for the man at bat for the National team", to "Put in the score for the [home—team], and finally to "Put in the score for the [away team]". The game echoes each user response and asks for verification of the user's inputs.

At step 145, the user is asked whether or not a fast pitch game is desired. In a fast pitch game, the blinking LEDs 72 used to indicate the flight of the ball blink at a faster rate. If the user responds to the game's query with a "YES", a flag is set to indicate that a fast pitch game is desired. If "NO", processing continues with no change.

At step 146, a single user playing against the computer is given the several different play options. For example, a single player may play for one team the entire game, bat the entire game, or pitch the entire game. A return to the setup routines loop then occurs.

After completion of all of the setup routines of step 100 in FIG. 3, the game begins execution of the game loop 200. The game loop 200 operates by repeatedly looping while simultaneously polling various "state machines", a "state machine" being a software module that performs specific actions based upon the value of its state variables (discussed earlier). However, each state machine may also change the value of a state variable used by another state machine, thereby causing that state machine to act differently the next time it is called in a loop. The game loop 200 continues in an idle loop until one of the various state variables employed by one of the state machines is altered.

The game loop 200 consists of a simple loop/subloop structure comprising an inning loop routine 201 and a game over inquiry step 202. If the game is not over (i.e. the number of innings played is less than nine), flow continues to step 203 wherein the inning number is incremented. If the number of innings played is nine, or eight and a half where the home team is ahead, flow proceeds to step 204, the game stops, and the winner is announced.

Figure 12:
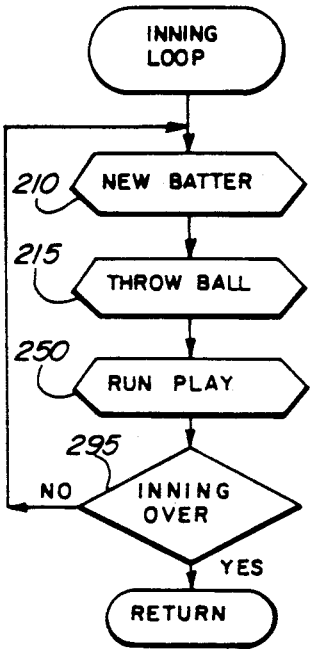
FIG. 12 is a flow chart of the Inning Loop which is the first step in the game loop of FIG. 11.
Figure 13:
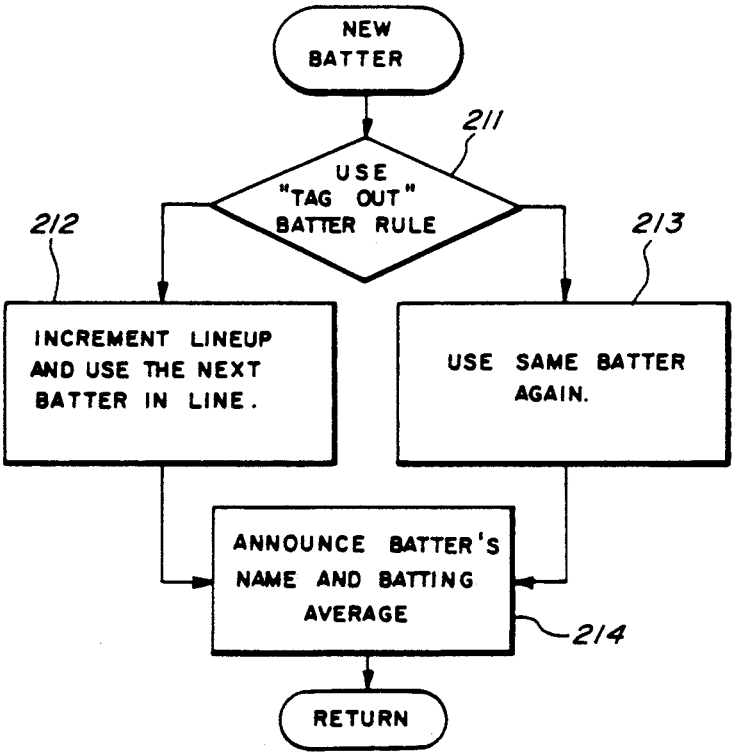
FIG. 13 is a flow chart of a New Batter routine used to bring increment batters.

As shown in FIG. 12, the inning loop routine 201 is comprised of a new batter routine 210, a throw ball routine 215, and a run play routine 250. As further shown in FIG. 13, the new batter routine 210 determines, in step 211, whether or not the "tagged out" batter rule is necessary. The "tagged out" batter rule applies when the previous inning ended with a base runner being tagged out. If the "tagged out" rule applied, step 213 uses the same batter who was at bat when the previous inning ended. If the previous inning ended with the batter causing the out (as is usually the case ), the "tagged out" rule does not apply, the lineup is incremented in step 212, and the next batter in the lineup is brought to bat. After bringing a batter to the plate in accordance with either step 212 or step 213, the game announces the batter's name and batting average in step 214.

The inning loop 201 then proceeds to the throw ball routine of step 215. As shown at step 246 of FIG. 14, the throw ball routine 215 will continuously loop until a pitch is thrown and hit. As further shown in FIG. 14, the throw ball routine 215 is comprised of a batter machine 216, an advance runners and score routine 225, a pitcher machine 230, and a pitch announcer 235. Each of the above routines will now be described in detail with reference to the drawings.

Figure 15:
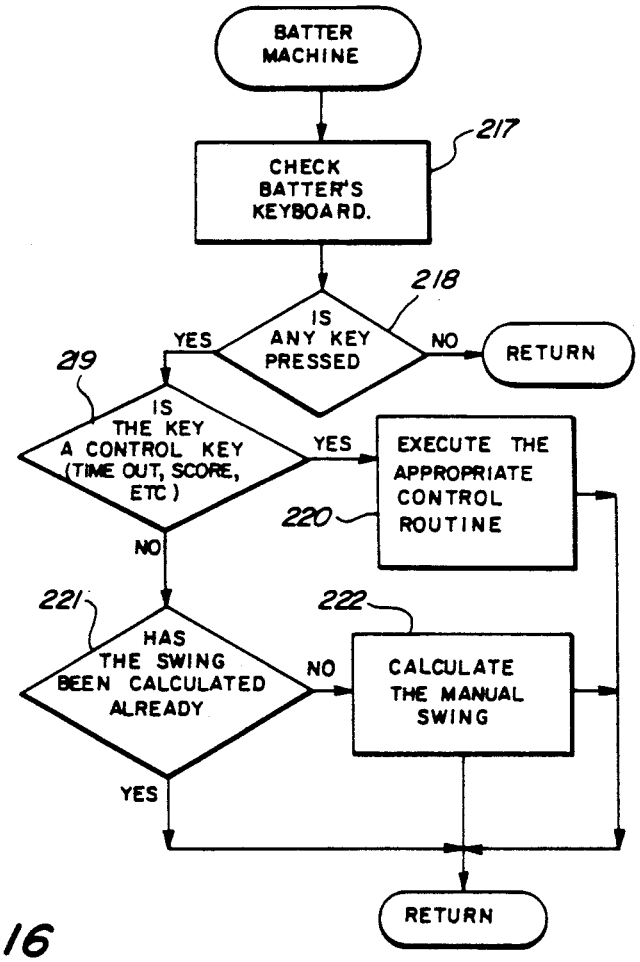
FIG. 15 is a flow chart of the Batter Machine used to check for key presses on the batting control panel and to calculate distance and direction of hit balls.

The batter machine 216 is shown in FIG. 15. First, it determined with step 217 and step 218 whether or not the user has pressed a key on the batter's keyboard 56. If "no", the program continues to the next routine comprising the throw ball routine 215. If a key has been pressed on the batter's keyboard 56, step 219 checks to see if the key was a control key (e.g. time out, score, pinch hitter, or pinch runner), and if so, the appropriate control routine is executed at step 220. If the key press was not a control key, it is determined in step 221 whether or not the user has already entered a desired swing type and/or position since a pitch state variable indicates that the ball has left the pitcher's hand and is in the air. The user may not alter his swing selection after the ball is in the air, hence processing will proceed to the next routine comprising the throw ball routine 215. If this were the first time the batting user had entered a swing selection, processing would proceed to step 22 where the probability of a hit occurring is calculated based upon the timing of the swing key-press (explained further herein), the selected position of the swing (if any), the batter's batting average, and the pitcher's earned run average.

Figure 16:
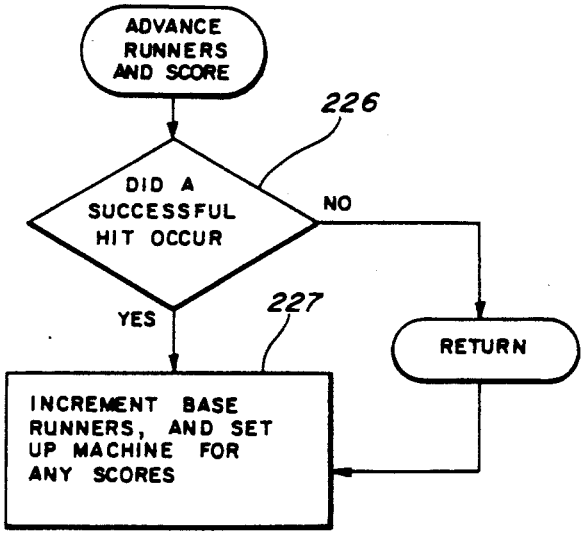
FIG. 16 is a flow chart of the Advance Runners and Score routine.

Next, processing continues with the "advance runners and score" routine 225, the steps of which are depicted in FIG. 16. At step 226, processing simply continues to the next routine of the throw ball routine 215 if not hit occurred in step 222 of the batter machine 216. If a hit did occur, Step 227 operates such that any runners on base are advanced to the next base or bases and such that the score is incremented for any base runner that is advanced across home. A return is then executed.

Figure 14:
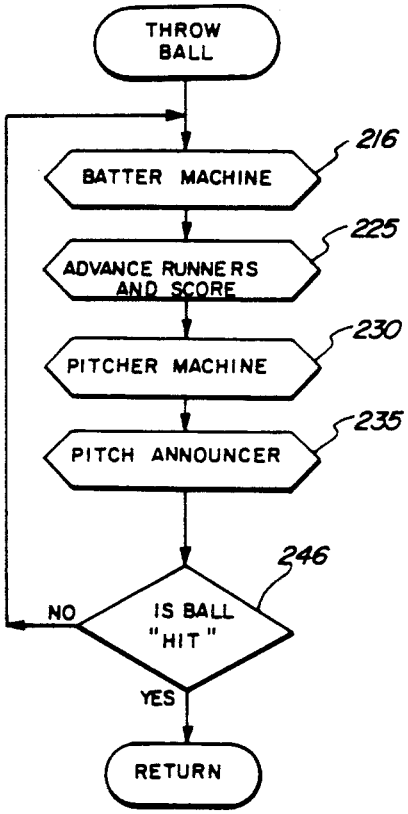
FIG. 14 is a flow chart of a Throw Ball Loop wherein the ball must be thrown and hit to exit the loop.
Figure 17:
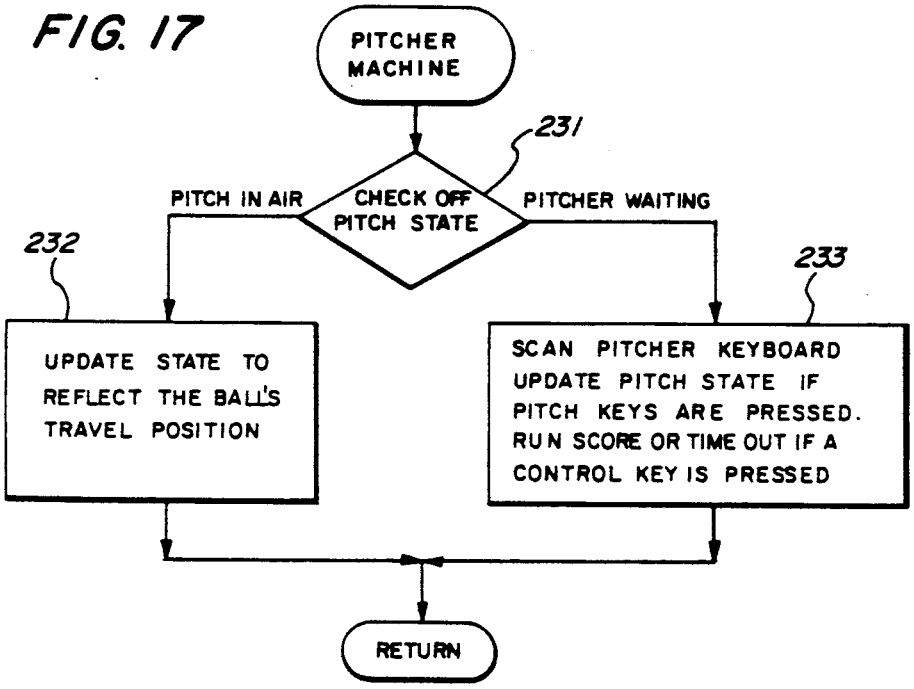
FIG. 17 is a flow chart of the Pitcher Machine used to check for key presses on the pitching control panel and to update a state variable representative of the flight of the pitched ball.

As shown in FIG. 14, the pitcher machine 235 follows the "advance runner and score" routine 225. The internal steps of the pitcher machine are generally depicted in FIG. 17. At step 231, a check is made to a pitch state variable in order to determine the appropriate action. If the pitch state variable indicates that pitching user has not yet pressed a key on the pitching keyboard 54 or has to this point only selected the type of pitch but has not yet released the ball, processing proceeds to step 233 wherein the pitching keyboard is scanned for a pitching action or a control key-press. If however, the pitch state variable indicates that the pitch is "in the air", processing continues with step 232 wherein a state variable representing the ball's travel position is updated, the appropriate LEDs of the LED array 72 being lit in response thereto. The program then returns control to the next routine of the throw ball routine 215 of FIG. 14.

Figure 18:
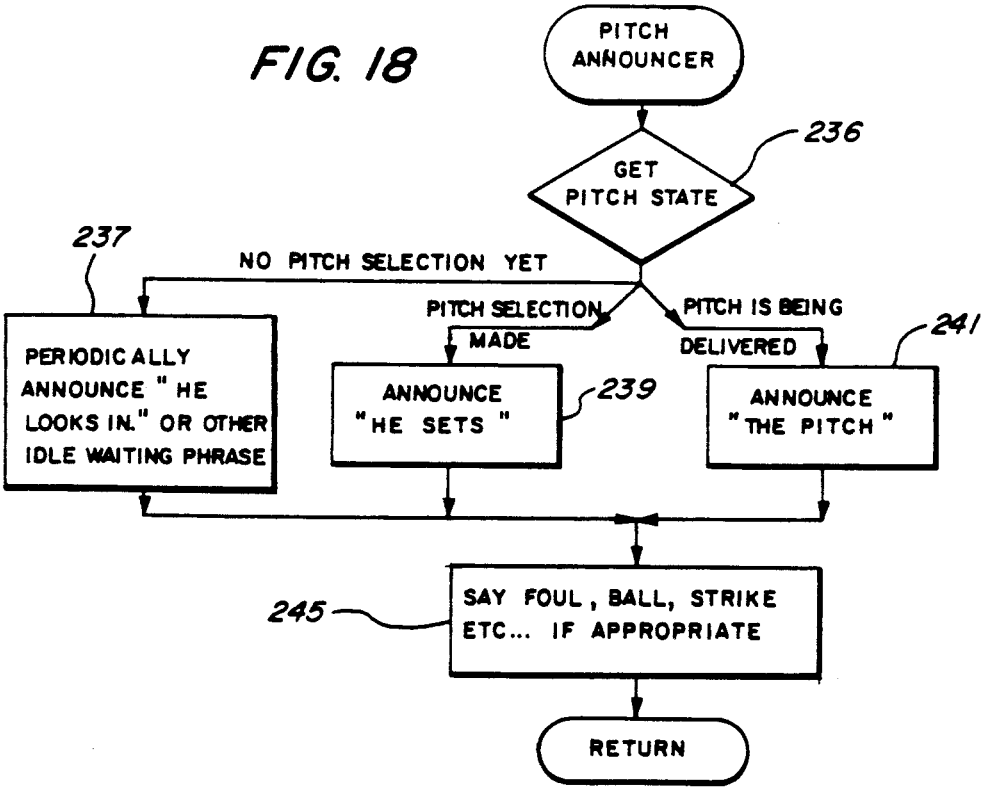
FIG. 18 is a flow chart of the Pitch Announcer routine used to announce various messages to the user.

The next routine is the pitch announcer routine 235, the flow of which is shown in FIG. 18. At step 236, the pitch state is retrieved. If the pitch state indicates that the game is ready for a pitch selection from the pitching user, but a selection has not yet been entered, step 237 periodically prompts the user by announcing "He looks in for the sign" or something similar. In addition, step 237 will mix in other idle waiting phrases ("loitering phrases") such as crowd sounds, the current score, etc... If the pitching user had previously entered a pitch type (fast, curve, or change-up) in step 233 of the pitcher machine, the program proceeds to step 239 after retrieving the pitch state in step 236. At step 239, the game announces "he gets it", "he sets", or some other similar phrase. If the pitch state indicates that the pitch is on its way at step 236, the game announces "the pitch", "here comes the pitch", "the pitch on the way", "here it comes", or some other similar phrase at step 241. Following either step 237, step 239, or step 241, the program executes step 244 wherein the lead off status of any runner on base is checked and reported to the users. At step 245, the result of the pitch is determined and reported to the users where appropriate.

After completion of the pitch announcer routine 235, a check is made at step 246 to determine whether the ball was pitched and hit during the immediately preceding pass through the throw ball routine 215. If the ball was not hit during the preceding pass, the program loops around and continues to execute the throw ball routine. If the ball was pitched and also hit, the program exits the throw ball routine 235 at step 246, returns to the inning loop, and then proceeds to the run play loop 250 of FIG. 12.

Figure 19:
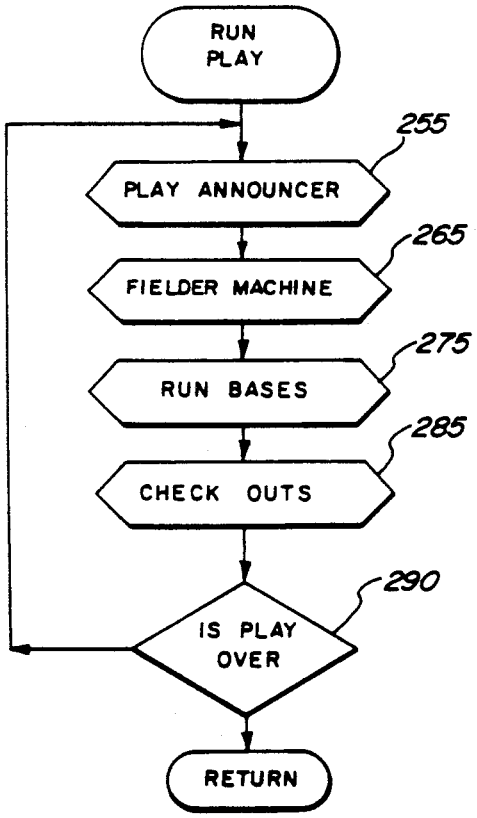
FIG. 19 is a flow chart of the Run Play Loop that is executed after a ball is pitched and hit in the Throw Ball Loop.

The run play loop 250, depicted in more detail in FIG. 19, is comprised of a play announcer routine 255, a fielder machine 265, a run bases routine 275, and a check outs routine 285.

Figure 20:
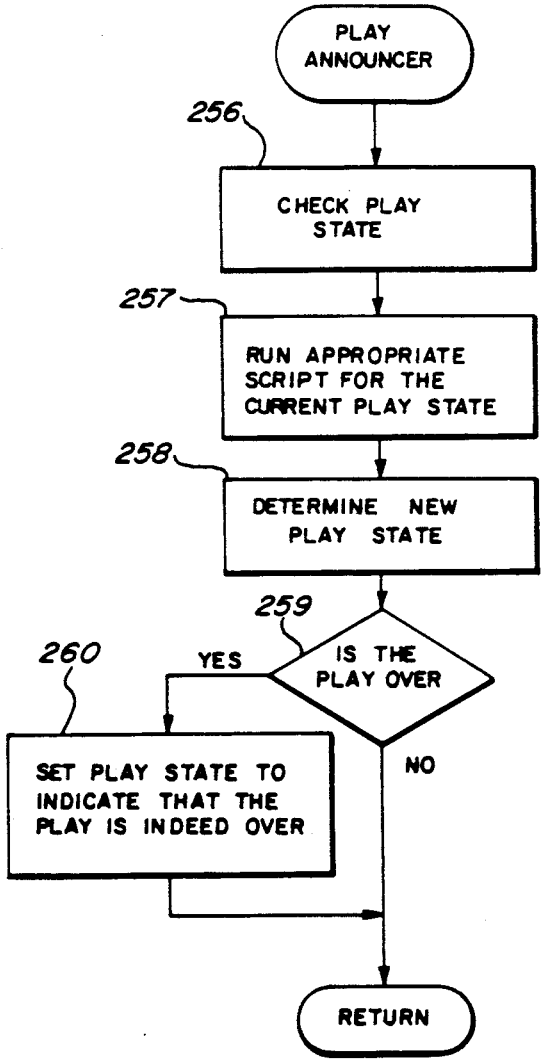
FIG. 20 is a flow chart of the Play Announcer routine used to announce messages regarding the current play state.

After a ball has been pitched and hit in the throw ball loop 250, program processing continues in the play announcer routine 255, the steps of which will now be described in reference to FIG. 20. At step 256, a group of variables representative of the play state are checked to determine the appropriate script to be announced. Exemplary variables indicative of the play state include a variable that represent the distance and direction of the ball's flight, a variable that represent which zone, from a predetermined group on zones, the ball will land in, a variable representing the number of and position of runners on base, etc... At step 257, a script from a group of scripts set appropriate for the current play state is output to the user. At step 258, a subsequent play state is determined. For instance, whether the ball is a grounder, a fly ball, or a home run; whether the ball is caught or dropped, etc... At step 259, a check is made to determine whether the play is over or not. If the play is indeed over, the play state is set to indicate the play is over in step 260, thereby causing the run play loop to terminate at step 290 of FIG. 19. If the play is not over, a return is executed and processing within the run play loop 250 continues.

Figure 21:
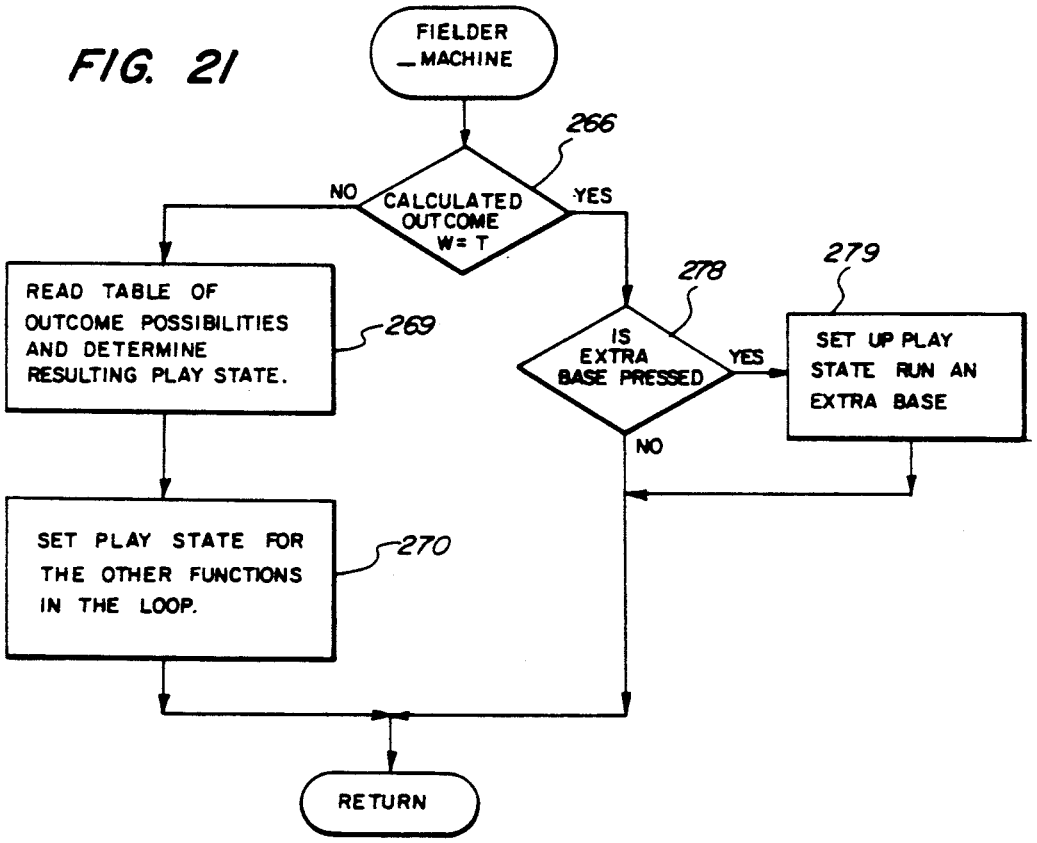
FIG. 21 is a flow chart of the Fielder Machine used to determine the play results of hit balls.

The fielder machine is entered at step 265 immediately after execution of the play announcer routine 255. The fielder machine 265, shown in FIG. 21, initially determines whether a play result has been calculated for the play state yet. If not, processing proceeds to step 289 where a probable play result is determined by examining a table of results. The contents of the table are outcome possibilities based upon the direction and distance of the hit ball, the zone where the hit ball will land, the type of hit (pop-up, fly ball, line drive, etc...), and the number of runners on base. At step 270, the probable result of the play state is set based upon the contents of the table of results. If the play result had already been calculated in an earlier pass through the run play loop 250, processing proceeds from step 266 to step 278 where it is determined whether or not the batting user has presses the Extra Base button. If so, the play state is set up to attempt to run an extra base. If not, processing simply returns to the run play loop 250.

Figure 22:
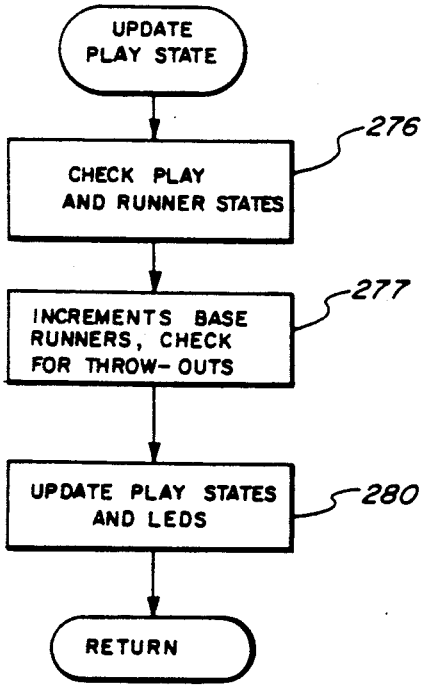
FIG. 22 is a flow chart of Update Play State routine used to increment base runner, strikes, etc.

The next routine of the run play loop 250 is the update play state routine 275, the details of which are shown in FIG. 22. The update play state routine first checks the play state and the runner state at step 276 and then increments the base runners, strikes, and outs. At step 280, the play state is updated if necessary. For example, if there three strikes, the play state is updated to reflect an additional out.

Figure 11:
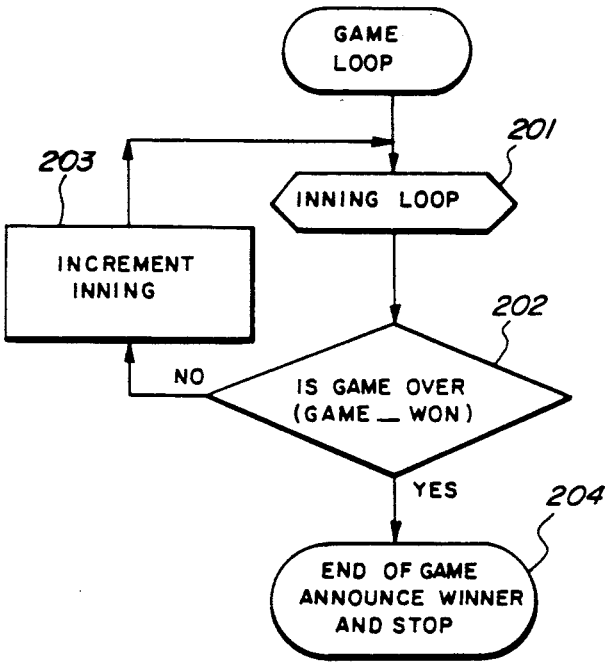
FIG. 11 is a flow chart of the Game Loop shown in FIG. 2.
Figure 23:
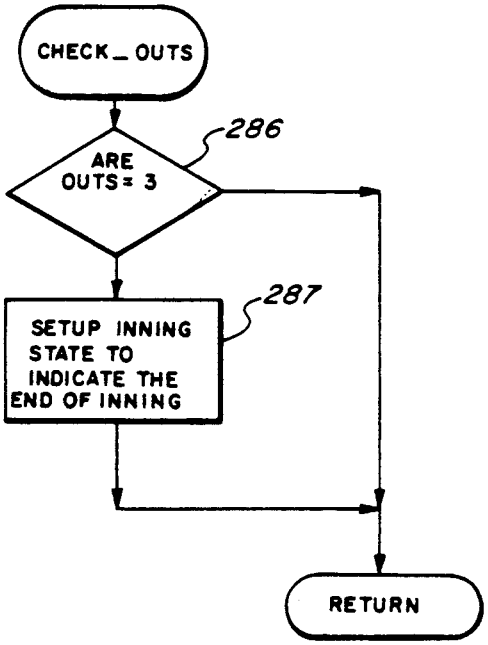
FIG. 23 is a flow chart of the Check Outs routine used to check the number of outs and to increment the inning number in accordance therewith.

The check outs routine 285, shown in FIG. 23, determines if the number of outs is three at step 286, and if so, modifies the inning state variable to indicate the end of an inning. If there are not three outs, control returns to the run play loop 250 where the play state is examined at step 290 in order to determine whether the play is over. If the play is not over, the run play loop 250 is repeated. If the play is over, a return is executed and the program returns to the inning loop of FIG. 12. At step 295 of the inning loop of FIG. 12, the play state setup by the check outs routine 290 of FIG. 23 is examined. If the inning is not over, the inning loop is repeated. If the inning is over, a return is executed and control returns to the game loop of FIG. 11. As described earlier, a check is made whether the game is over at step 204 in FIG. 11. If not, the inning is incremented and the game loop is repeated. If the game is over, processing continues to step 204 where the winner of the game is announced.

While the above features of the present invention teach an apparatus for an interactive audio baseball game, it can be readily appreciated that it would be possible to deviate from the above embodiment of the invention to, for example a football game or some other interactive game. As will be readily understood by those skilled in the art of electronic games, the invention is capable of many modifications and improvements within the scope and spirit thereof. Accordingly, it will be understood that the invention is not to be limited by the specific embodiments but only by the spirit and scope of the appended claims.

What we claim is:

1. A microprocessor based interactive audio baseball game having a predetermined number of possible game states comprising:

visual means for designating the path of a ball thrown with a pitch game play and for producing a flashing visual output representative of the path of the simulated flight of the thrown ball and the time interval during which a hit game play may take place, said visual means comprising a plurality of visual indicators arranged in a grid that represents the flight of a thrown ball through a vertical cross section of the strike zone, said visual indicators being sequentially flashed a predetermined number of times and in a predetermined pattern for a particular variety of pitch, said predetermined number of flashes indicating the time interval during which the hit game play may take place and said predetermined pattern indicating the path of the simulated flight of the thrown ball;

input means for at least one participant to vary the state of the game, said input means including a grid of keys corresponding to said plurality of visual indicators arranged in a grid whereby said participant, by depressing an appropriate one of said keys, may simulate a swing at a particular time and through a particular location in response to a simulated pitch;

audio means for providing to the participant an audio output indicative of a particular game state, and means for variably selecting one of a plurality of audio outputs which correspond to a particular game state whereby the participant is provided with a variety of different audio outputs for the same game state.

2. The baseball game of claim 1 is a sports simulation game further comprising means for storing and retrieving statistical sets corresponding to the past performance of actual players, the game state being variably selected in accordance with the input means and the statistical sets.

3. The baseball game of claim 1 further comprising second visual means for indicating when one or more runners are on base.

4. The baseball game of claim 1 wherein the variable selection means comprises a software module which randomly selects a phrase from a list of phrases suitable for the same game state.

5. An audio baseball game comprising:

means for storing and retrieving statistical sets corresponding to the past performance of major league baseball players;

input means for allowing one or more participants to select a game play allowable during a particular game state, the outcome of the game play being variably determined in accordance with the retrieved statistical sets;

visual means for designating the path of a ball thrown with a pitch game play and for producing a flashing visual output representative of the path of the simulated flight of the thrown ball and the time interval during which a hit game play may take place, said visual means comprising a plurality of visual indicators arranged in a uniform grid that represents the flight of a thrown ball through a vertical cross section of the strike zone, said visual indicators being sequentially flashed a predetermined number of times and in a predetermined pattern, said predetermined number of flashes indicating the time interval during which the hit game play may take place and said predetermined pattern indicating the path of the simulated flight of the thrown ball;

said input means including a grid of keys corresponding to said plurality of visual indicators arranged in a grid whereby said participant, by depressing an appropriate one of said keys, may simulate a swing at a particular time and through a particular location in response to a simulated pitch;

audio means for providing an audio output to the participants, the audio output being indicative of either the outcome of a particular game play or of the current game state, and variable selection means for causing the audio means to provide one of a plurality of possible audio outputs which correspond to a particular game play outcome or game state.

6. The audio baseball game of claim 5 further comprising a second input means for allowing participants to change batting lineups or field positions.

7. The audio baseball game of claim 5 further comprising visual means for indicating when one or more runners are on base.

8. The audio baseball game of claim 5 wherein the variable selection means comprises a software module which randomly selects a phrase from a list of phrases suitably corresponding to a particular game play outcome or game state.

9. An audio baseball game where the play of the game is affected by a combination of major league baseball player' statistics and at lease one user's directions comprising:

means for storing and retrieving pitcher and batter statistical sets;

game play processing means for simulating the game plays of a baseball game based upon the statistical sets and for producing output results, said game plays comprising pitching, batting, and base running game plays;

visual means for indicating the position of a simulated ball thrown in the pitching game play, said visual means comprising a uniform grid of visual indicators that are sequentially flashed, the number of flashed visual indicators representing a simulated position between the pitcher and home plate and the pattern defined by the flashed visual indicators representing a simulated position from the catcher's viewpoint;

input means for allowing at least one user to direct the play of the game play processing means in conjunction with the statistical sets, to thereby affect the output results;

said input means including a grid of keys corresponding to said uniform grid of visual indicators whereby said participant, by depressing an appropriate one of said keys, may simulate a swing at a particular time and through a particular location in response to a simulated pitch; audio means for vocalizing a particular output result whereby the user is provided with a vocal description of the game play.

10. The audio baseball game of claim 9 wherein the input means comprises a set of pitcher control buttons including:

pitch-type select buttons used to select the type of pitch thrown, for example a fast ball, a curve ball, or a change-up;

pitcher action control buttons used to select particular pitcher actions, for example a pitchout, a pick-off, or an intentional walk, and pitching managerial control buttons used to control the who plays and at what position, for example bringing in a relief pitcher, substituting players, changing field positions, or bringing the infield in or out.

11. The audio baseball game of claim 9 wherein the input means comprises a set of batter control buttons including:

swing-type control buttons used to select the type of swing, for example a bunt, a squeeze play, or a power swing;

hitting managerial control buttons used to control who hits or runs, for example bringing in a pinch hitter, bringing in a pinch runner, or stealing a base.

12. The audio baseball game of claim 9 further comprising means for varying the vocalization produced by the audio means for a particular output result whereby the user may be provided with varying vocal descriptions of the same output result.

13. The audio baseball game of claim 9 further comprising means for substituting one statistical set for another.

14. The audio baseball game of claim 13 wherein the substituting means comprises interchangeable memory cartridges, each memory cartridge having stored therein one or more pitcher and batter statistical sets.

15. The audio baseball game of claim 9 further comprising visual means for indicating when one or more runners are on base.

* * * * *